US005417427A

United States Patent [19]

Doane

[11] Patent Number: 5,417,427

[45] Date of Patent: May 23, 1995

[54] GOLF TRAINING DEVICE

[76] Inventor: Maurice S. Doane, 3014 SW. 40th St., Des Moines, Iowa 50321

[21] Appl. No.: 140,403

[22] Filed: Oct. 25, 1993

[51] Int. Cl.[6] ..... A63B 69/36

[52] U.S. Cl. ..... 273/186.4; 273/185; 273/197 A

[58] Field of Search ..... 273/186.1, 196, 187 R, 273/197 A, 186.4, 198, 187 B, 35 R, 184 R, 185 D

[56] References Cited

U.S. PATENT DOCUMENTS

| | | | |
|---|---|---|---|
| 1,419,636 | 6/1922 | MacDonald . | |
| 3,512,417 | 5/1970 | Anello | 273/186.1 |
| 3,622,161 | 1/1971 | Kepper | 273/186.1 |
| 3,754,764 | 8/1973 | Manheck . | |
| 4,084,822 | 4/1978 | Keeton | 273/186.1 |
| 4,146,231 | 3/1979 | Merkle et al. | 273/187 R |
| 4,441,716 | 4/1984 | Chen . | |
| 4,603,862 | 8/1986 | Chen . | |
| 4,949,973 | 8/1990 | Williamson . | |

*Primary Examiner*—Mark S. Graham
*Attorney, Agent, or Firm*—Henderson & Sturm

[57] ABSTRACT

A golf training device including a captured tee having a lower end pivotally attached to a frame and an upper end attached to a target golf ball. The tee is movable between a vertical position wherein the target golf ball is positioned to be struck by a golf club, and a generally horizontal position wherein the ball strikes an impact surface. A base member such as mesh screen overlies the impact surface, and a flexible imaging-type material such as carbonless imaging paper overlies the base member. When the target golf ball strikes the flexible imaging material, a circular imprint is formed on the imaging material and the diameter of the imprint is indicative of the force applied to the ball and therefor the distance the stroke would drive a conventional golf ball. The direction the stroke would project a conventional golf ball is alternatively indicated by linear imprints superimposed on the circular imprint, the position of the circular imprint relative to the edge of the imaging material and the orientation of a direction indicating imprint. Also, the direction of spin imparted to a conventional golf ball by the stroke is indicated by a point imprint superimposed upon the circular imprint.

22 Claims, 5 Drawing Sheets

GOLF TRAINING DEVICE

TECHNICAL FIELD

This invention relates to a sports training apparatus, and more particularly to a golf training device.

BACKGROUND ART

Numerous golf training devices are available to assist golfers in improving various aspects of their game. The tee shot is generally made using one of the clubs known as woods numbered 1, 2 and 3. Golfers strive to achieve consistent distance and direction in their tee shots.

The woods have a substantially vertical club face which contacts the golf ball and imparts a spin on the struck golf ball either in a clockwise or counterclockwise direction depending on the orientation of the club face as it strikes the golf ball. As the forward velocity of the struck golf ball decreases, the spin direction has an increasing influence on the path the ball will follow. A clockwise spin tends to direct the ball to the right, and the counterclockwise spin tends to direct the ball to the left.

No known golf training device provides a permanent record of the distance, direction, and ball spin of practice shots that can be reviewed by the golfer to make the necessary body and grip adjustments to correct errant shot direction.

Those concerned with these and other problems recognize the need for an improved golf training device.

DISCLOSURE OF THE INVENTION

The present invention provides a golf training device including a captured tee having a lower end pivotally attached to a frame and an upper end attached to a target golf ball. The tee is movable between a vertical position wherein the target golf ball is positioned to be struck by a golf club, and a generally horizontal position wherein the ball strikes an impact surface. A base member such as mesh screen overlies the impact surface, and a flexible imaging-type material such as carbonless imaging paper overlies the base member. When the target golf ball strikes the flexible imaging material, a circular imprint is formed on the imaging material and the diameter of the imprint is indicative of the force applied to the ball and therefore the distance the stroke would drive a conventional golf ball. The direction the stroke would project a conventional golf ball is alternatively indicated by linear imprints superimposed on the circular imprint, the position of the circular imprint relative to the edge of the imaging material and the orientation of a direction indicating imprint. Also, the direction of spin imparted to a conventional golf ball by the stroke is indicated by a point imprint superimposed upon the circular imprint.

An object of the present invention is the provision of an improved golf training device.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
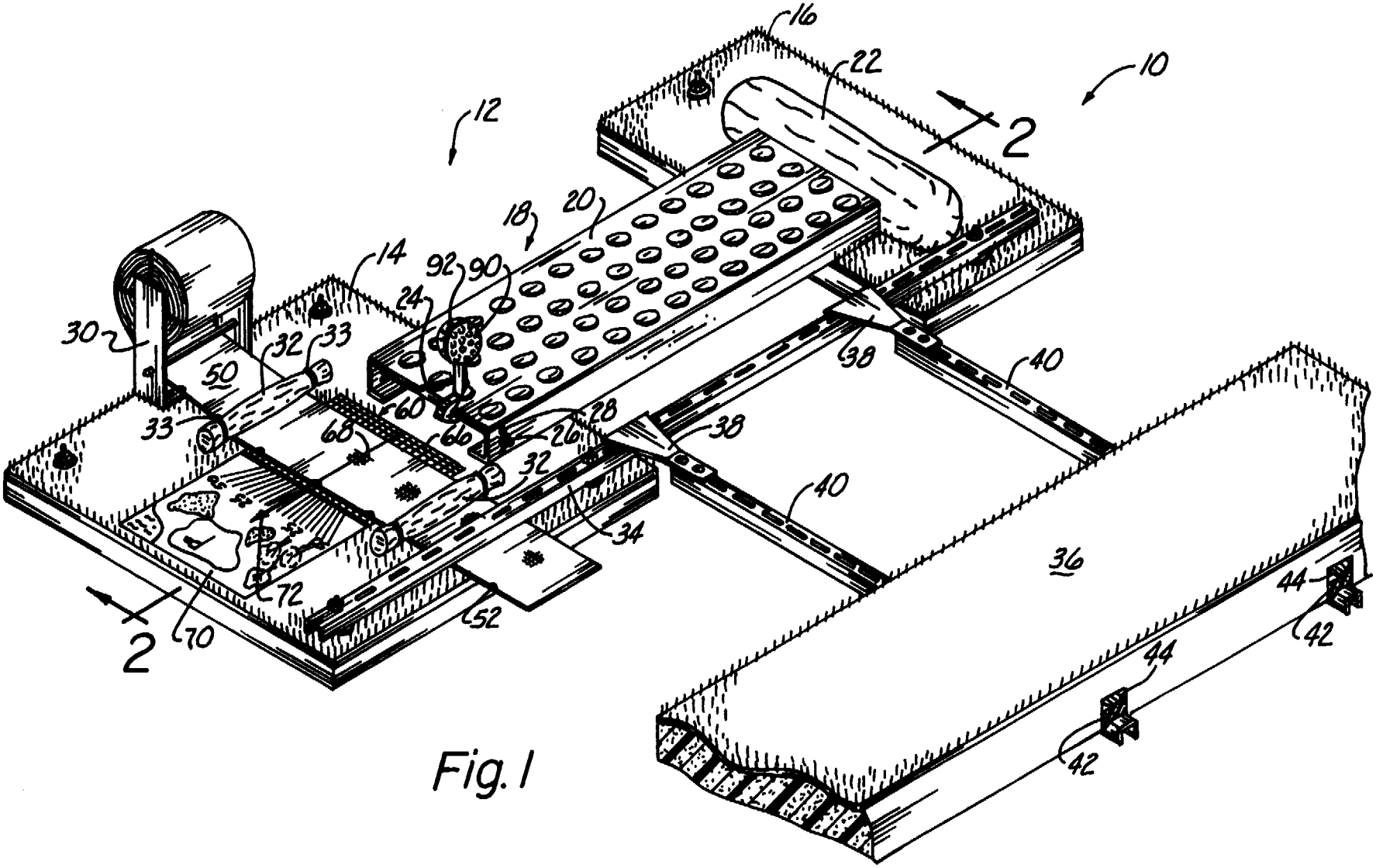
FIG. 1 is a perspective view of the golf training device of the present invention.

Referring now to the drawings, wherein like reference numerals designate identical or corresponding parts throughout the several views, FIG. 1 shows the golf training device (10) of the present invention. The training device (10) includes a frame (12) having front and rear platforms (14 and 16) formed of layers of plywood and plastic foam covered by an outdoor-grade carpet. A channel member (18) spans and interconnects the front and rear platforms (14 and 16). The channel member (18) is covered by a rubber material (20) having a raised dot surface. The rear of the channel member (18) carries a sponge rubber cushion (22) and a V-shaped notch (24) is formed in the front of the channel member (18). A socket axle bolt (26) extends between opposing legs of the channel member (18) at one of three elevations provided by vertically spaced openings (28).

The front platform (14) carries a dispenser (30) that dispenses a continuous web of carbonless imaging paper (50) from a roll. The paper (50) is feed under friction guides (32) and under the slotted bar (34). The friction guides (32) are made of foam rubber rods secured in position by rubber bands (33). An impact surface (60) and a base member (66) underlie the paper (50) and a nylon line (68) extends fore and aft of the impact surface (60) over the paper (50). A direction chart (70) is positioned forward of the paper (50) and includes a center arrow (72) aligned with the nylon line (68). An adjustable foot pad (36) is formed of plywood and plastic foam covered by an outdoor-grade carpet similar in construction to the front and rear platforms (14 and 16) but having a thicker plastic foam layer so the elevation of the foot pad (36) is approximately the same as the elevation of the channel member (18). The foot pad (36) is adjustably secured to the slotted bar (34) by locking tabs (38) carried on the ends of track members (40). The track members (40) are received in slots (42) formed in the underside of the foot pad (36). The weight of the golfer on the foot pad compresses the sponge lining (44) and holds the foot pad (36) in position.

Figure 7:
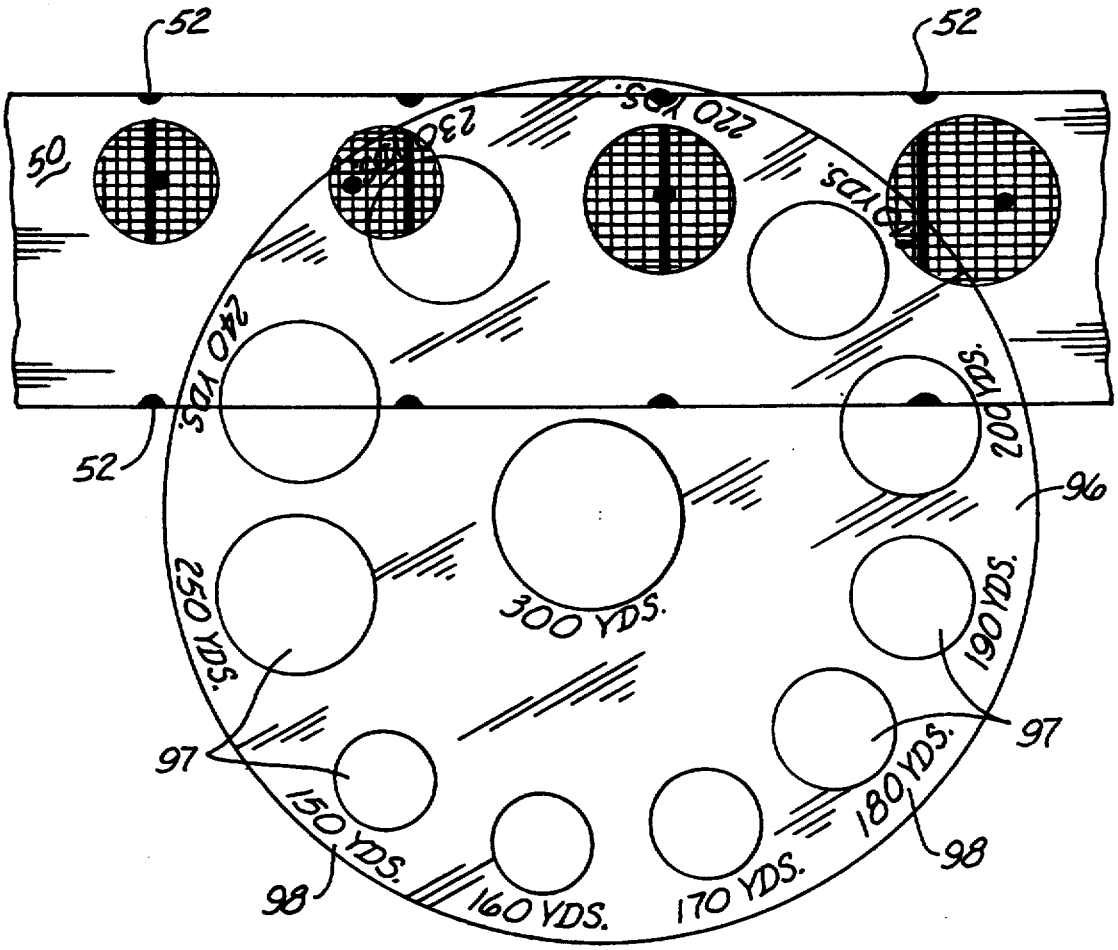
FIG. 7 is an enlarged top plan view of a segment of carbonless imaging paper showing the circular imprints with superimposed linear imprints and point imprints, and illustrating the use of the distance template to match the size of the circular imprint to the corresponding template circular marking and distance indicia.
Figure 8:
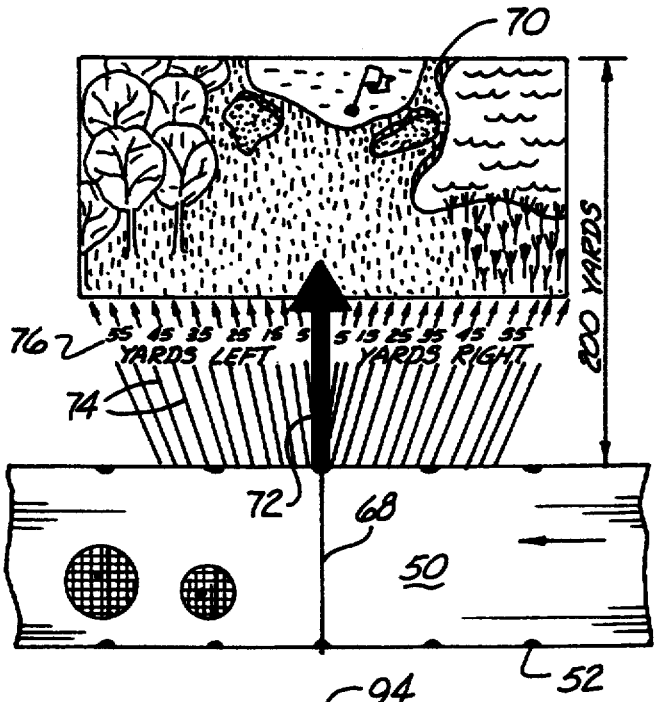
FIG. 8 is a top plan view illustrating the orientation of the golf club face with respect to the direction chart as the club strikes the target golf ball, the dashed lines indicating the club face aimed left and right of the target arrow on the direction chart.
Figure 8:
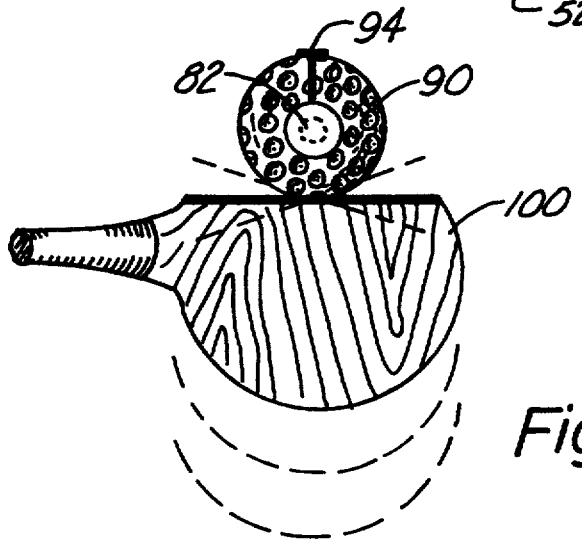
Figure 9:
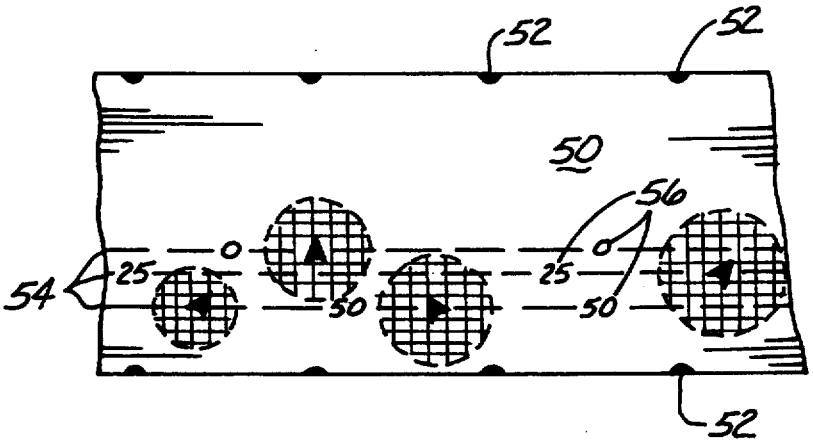
FIG. 9 is an enlarged top plan view of a segment of carbonless imaging paper having parallel linear markings and associated yardage indicia used to record the direction a target golf ball is projected, also direction indicating imprints formed by a direction indicator pin are illustrated.

As best shown in FIGS. 1 and 7–9, the paper (50) is dispensed as a continuous 2¼" wide web. The paper (50) is a flexible imaging-type material such as carbonless imaging paper. The paper (50) is of a type suitably adapted to produce an image at the point of application of an external force. The flexible imaging-type material may be any such known material, for example "type 100" carbonless paper sold under the trademark "3M BRAND" by Minnesota Mining and Manufacturing Company of Saint Paul, Minn. or the self-contained paper sold under the trademark "NCR PAPER" by Appleton Papers, Inc. of Appleton, Wis., a subsidiary of NCR. The paper (50) includes ink imprinted dots (52) at the edge at regular intervals along the web to align with the nylon line (68) and the center arrow (72). FIG. 9 shows a paper (50) which includes parallel linear markings (54) and yardage indicia (56) associated with the linear markings (54) for use in recording direction.

Figure 2:
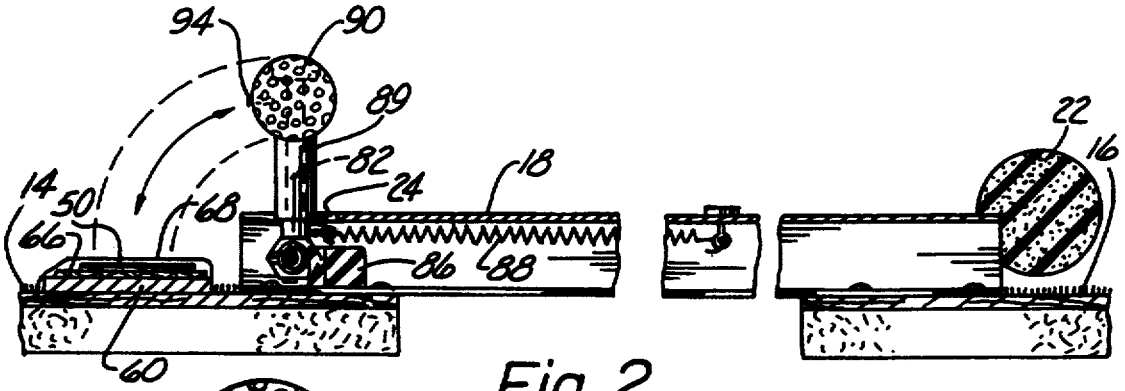
FIG. 2 is a side elevation sectional view taken along line 2—2 of FIG. 1.
Figure 5:
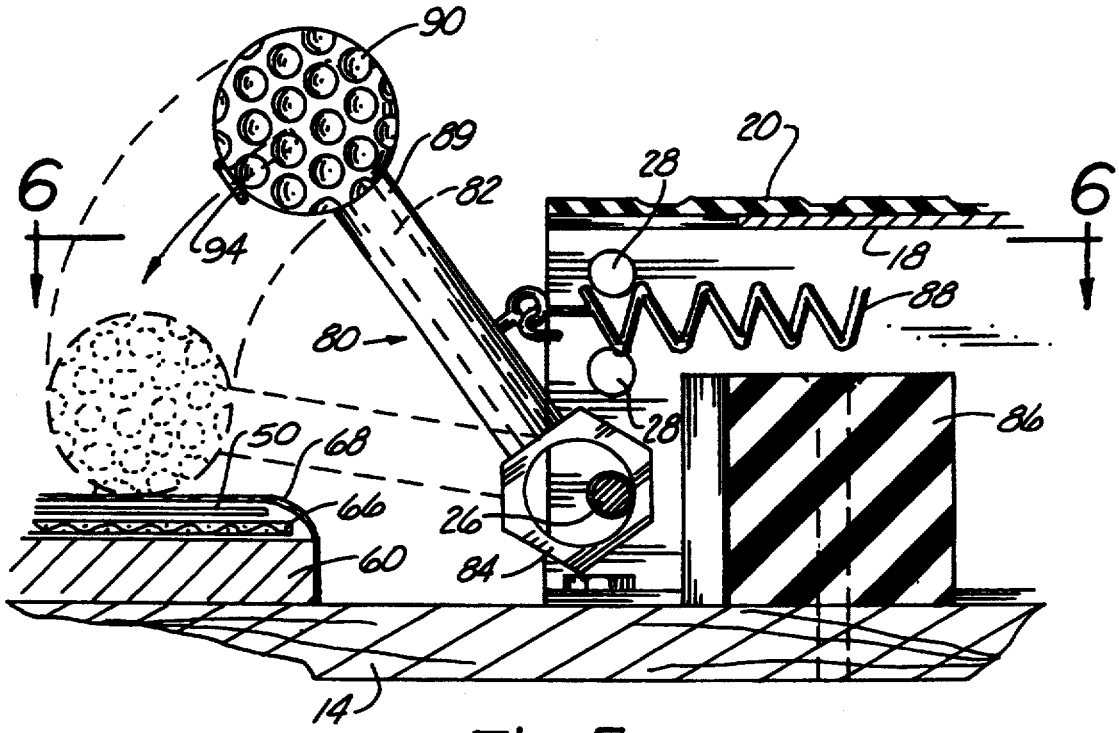
FIG. 5 is an enlarged sectional view similar to FIG. 3, but showing the captured tee moving to the generally horizontal position.

As most clearly shown in FIGS. 1, 2 and 5, the impact surface (60) includes a steel plate wrapped with duct tape to deaden the sound. The base member (66) overlies the impact surface (60) and includes a surface pattern such as the pattern formed by a mesh screen. A fiberglass mesh screen has been successfully used as a base member (66) since it is relatively non-abrasive and does not easily cut through the overlying paper (50). A 50-pound nylon line (68) extends over the paper (50).

As best shown in FIGS. 1 and 8, the direction chart (70) includes a golf scene and a center arrow (72) indicating the desired direction of the golf shot. A number of direction arrows (74) are spaced at intervals on both sides of the center arrow (72) and distance indicia (76) correspond to the direction arrows (74) and indicate the distance the stroke deviates left or right of the desired direction.

Figure 3:
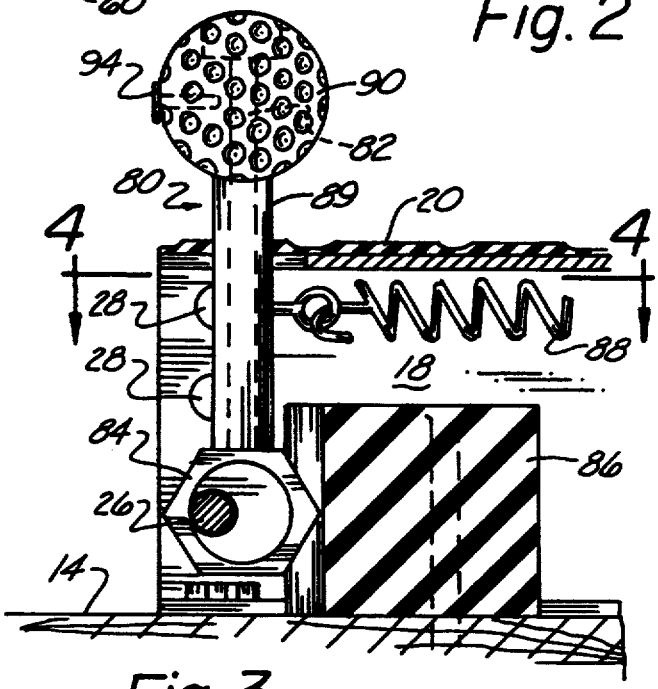
FIG. 3 is an enlarged sectional view showing the captured tee in the vertical position.
Figure 4:
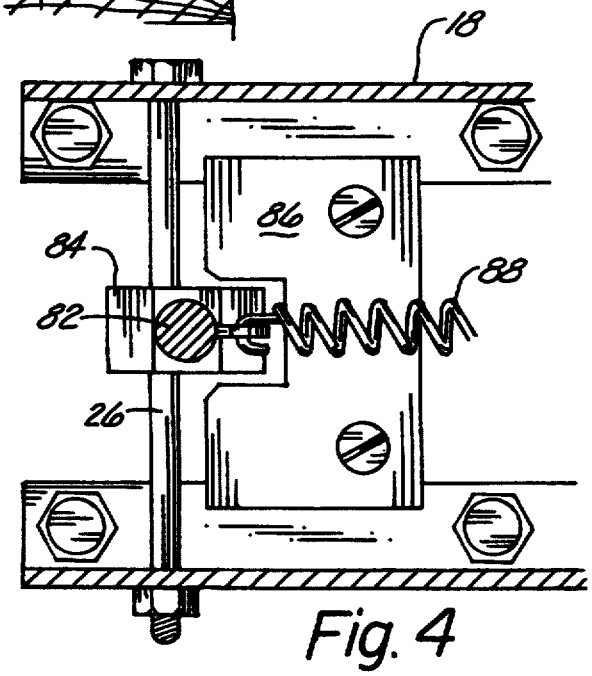
FIG. 4 is a top plan sectional view taken along line 4—4 of FIG. 3.
Figure 6:
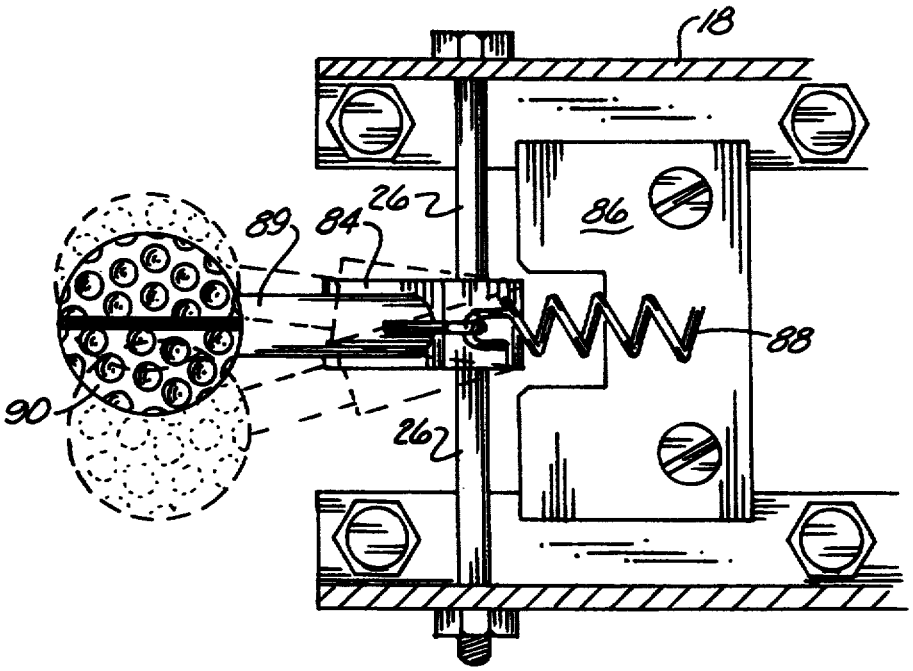
FIG. 6 is a top plan sectional view taken along line 6—6 of FIG. 5.

Referring now to FIGS. 1–6, the captured tee (80) includes a socket bolt (82) welded to a hex nut (84). The opening in the hex nut (84) receives the socket axle bolt (26). The hex nut (84) is received in a notch in a rubber block (86) and the socket bolt (82) is received in the V-shaped notch (24) at the front of the channel member (18). A spring (88) interconnects the socket bolt (82) at a point on the channel member (18) to the rear of the V-shaped notch (24). The spring (88) acts to automatically return the captured tee (80) to the vertical position. A rubber spacer (89) surrounds the socket bolt (82). FIGS. 3 and 4 illustrate the captured tee (90) in a vertical position posed to be struck by a golf club, while FIGS. 5 and 6 illustrate the captured tee (90) moving toward the substantially horizontal position where it strikes the impact surface (60).

A target golf ball (90) is attached to the top end of the socket bolt (82). The target golf ball (90) is formed of urethane and is drilled and counterbored to receive the shaft and enlarged head of the socket bolt (82). The ball (90) may be left free to rotate on the shaft of the socket bolt (82) or secured to prevent rotation by a pin or other suitable means when desired. As shown in FIG. 1, the ball (90) carries an alignment strip (92) and a center pin or direction indicator pin (94) positioned at the equator of the ball (90) and coincident with the strip (92). One embodiment of the center pin (94) forms a point imprint as illustrated in FIG. 7, while another embodiment forms a direction indicating imprint as illustrated in FIG. 9. A distance template (96) including circular markings (97) and distance indicia (98) is shown in FIG. 7 being used to match a circular ball imprint to determine distance.

In operation, the golfer positions the foot pad (36) at a comfortable position, positions the target golf ball (90) so that the strip (92) and pin (94) are aligned with the nylon line (68) and center arrow (70), and advances the paper (50) so that the edge dot (52) is positioned under the nylon line (68). As illustrated in FIG. 8, the face of the golf club (100) strikes the target ball (90) and moves the captured tee (80) from the vertical position illustrated in FIG. 3 to the substantially horizontal position illustrated by the dashed line showing in FIG. 5. It should noted that the nut (84) has an opening larger than the diameter of the axle bolt (26) and this allows the nut (84) to move forward from the notch in the rubber block (86) and allows movement of the target ball (90) to either side of center as illustrated by the dashed line showing in FIG. 6.

As shown in FIG. 7, when the target ball (90) strikes the paper (50), a circular imprint of the ball (90) in the pattern of the mesh screen (66) is formed on the paper. Also, the ball (90) strikes the nylon line (68) and forms a linear imprint on the paper (50) superimposed over the circular imprint. When the ball (90) is free to rotate on the socket bolt (82), the pin (94) moves to the right or left and makes a point imprint superimposed on the circular imprint. The size of the circular imprint indicates distance as measured by the template (96), the position of the linear imprint with respect to the underlying circular imprint indicates direction—and considered with the direction chart (70) indicates yardage left or right of the desired direction, and the position of the point imprint with respect to the circular imprint indicates direction and amount of spin imparted to the ball (90). The paper (50) may be advanced for each practice shot and provides a permanent record of each shot for immediate and later analysis by the golfer so that appropriate adjustments can be made.

FIG. 9 illustrates an alternate embodiment of the paper (50) having parallel linear markings (54) and yardage indicia (56). As the ball (90) is directed further to the right or left of center, the circular imprint is formed closer to the edge of the paper (50) since the length of the socket bolt (82) is constant. The position of the circular imprint with respect to the edge of the paper (50) is therefore an indication of direction and the linear markings (54) and yardage indicia (56) assist in quantifying the deviation from a straight shot.

Also, FIG. 9 shows a direction indicating imprint in the shape of an arrowhead which is formed on the paper (50) by contact of the direction indicator pin (94). In this embodiment, the ball (90) is secured against rotation on the socket bolt (82) so that the direction indicating imprint will be centered on the circular imprint in each occurrence. The position of the direction indicating imprint with respect to the edge dot (52) together with the direction the arrowhead is directed indicates the direction right or left of the desired target direction.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. A golf training device, comprising:

a frame having a top surface a target golf ball;

an impact surface disposed on the top surface of said frame;

a captured tee having a lower end pivotally attached to the frame and an upper end attached to the target golf ball, the captured tee being movable between a generally vertical position wherein the target golf ball is positioned to be struck by a golf club, and a generally horizontal position wherein the target golf ball strikes the impact surface; and means disposed on the impact surface for recording the approximate force applied to the target golf ball by the golf club, the recorded force being indicative of the distance the stroke would drive a conventional golf ball.

2. The golf training device of claim 1 wherein the force recording means includes:

a base member having a surface pattern attached to and disposed over the impact surface; and flexible imaging-type material disposed over the surface pattern of the base member and being selectively positioned to underlie the target golf ball when the captured tee is driven to the generally horizontal position, wherein the target golf ball striking the flexible material forms a circular imprint of the surface pattern on the flexible material, the imprint having a diameter indicative of the force applied to the target golf ball.

3. The golf training device of claim 2 wherein the base member is a mesh screen.

4. The golf training device of claim 2 wherein the flexible imaging-type material is carbonless imaging paper.

5. The golf training device of claim 4 wherein the carbonless imaging paper is a continuous web fed from a roll, and wherein the roll is rotatably mounted on a dispenser attached to the frame.

6. The golf training device of claim 5 wherein friction guides are attached to the frame on opposite sides of the impact surface, and wherein the web is selectively fed under the friction guides and secured in position over the surface pattern of the base member.

7. The golf training device of claim 6 wherein the imaging paper includes a marking spaced at regular intervals along the web, whereby positioning of the imaging paper is uniformly sequenced as it advances from the dispenser.

8. The golf training device of claim 1 further including:

means for biasing the captured tee toward the vertical position.

9. The golf training device of claim 1 further including:

means for adjusting the height of the captured tee with respect to the frame.

10. The golf training device of claim 2 further including:

a distance template having a plurality of circular markings of various diameters and corresponding indicia showing various distances, wherein a template circular marking when matched with the circular imprint on the flexible imaging-type material indicates the distance the stroke would drive a conventional golf ball.

11. The golf training device of claim 1 further including:

an adjustable foot pad attached to the frame and disposed to support a golfer in a selected position relative to the target golf ball.

12. A golf training device, comprising:

frame; having a top surface;

a target golf ball;

an impact surface disposed on the top surface of said frame;

a captured tee having a lower end pivotally attached to the frame and an upper end attached to the target golf ball, the captured tee being movable between a generally vertical position wherein the target golf ball is positioned to be struck by a golf club, and a generally horizontal position wherein the target golf ball strikes the impact surface; and means disposed on the impact surface for recording the direction the target golf ball is projected, the recorded direction being indicative of the direction the stroke would drive a conventional golf ball and the orientation of the golf club face when it strikes the target golf ball;

wherein the direction recording means includes:

a base member having a surface pattern attached to and disposed over the impact surface; and flexible imaging-type material disposed over the surface pattern of the base member and being selectively positioned to underlie the target golf ball when the captured tee is driven to a generally horizontal position, wherein the target golf ball striking the flexible material forms a circular imprint of the surface pattern on the flexible material.

13. The golf training device of claim 12 wherein the direction recording means further includes:

a linear member disposed over the flexible imaging-type material and positioned to underlie the target golf ball when the captured tee is driven to the generally horizontal position, wherein the target golf ball striking the linear member forms a linear imprint of the surface pattern superimposed upon the circular imprint and their relative positions are indicative of the direction the target golf ball is projected.

14. The golf training device of claim 13 wherein the linear member is a fiber line attached to the frame and extending fore and aft of the impact surface.

15. The golf training device of claim 12 wherein the direction recording means includes:

a plurality of linear markings carried on the imaging-type material and disposed parallel to each other, and indicia associated with each linear marking, wherein the position of the circular imprint with respect to the linear marking is indicative of the direction the target golf ball is projected.

16. The golf training device of claim 15 wherein the indicia represent yardage deviation to the right or left of a desired directional line.

17. The golf training device of claim 12 wherein the target golf ball is attached to the captured tee and fixed against rotation about the longitudinal axis of the tee and wherein the direction recording means further includes:

a direction indicator pin attached to and extending from the face of the target golf ball at a point on an equator of the target golf ball, wherein the direction indicator pin of the target golf ball striking the flexible material forms a direction indicating imprint of the surface pattern superimposed upon the circular imprint and the direction indicating imprint points in a direction indicative of the direction the target golf ball is projected.

18. The golf training device of claim 17 further including an alignment strip applied to the face of the target golf ball and disposed perpendicular to the equator in a line intersecting the direction indicator pin, whereby the alignment strip facilitates the positioning of the target golf ball so that the direction indicator pin is pointed in the desired direction before the target golf ball is struck by the golf club.

19. A golf training device, comprising:

a frame; having a top surface;

a target golf ball;

an impact surface disposed on the top surface of said frame;

a captured tee having a lower end pivotally attached to the frame and an upper end attached to the target golf ball, the captured tee being movable between a generally vertical position wherein the target golf ball is positioned to be struck by a golf club, and a generally horizontal position wherein the target golf ball strikes the impact surface; and means disposed on the impact surface for recording the spin direction imparted to the target golf ball, the spin direction being indicative of the spin direction the stroke would impart on a conventional golf ball, wherein the spin direction recording means includes:

a base member having a surface pattern attached to and disposed over the impact surface; and flexible imaging-type material disposed over the surface pattern of the base member and being selectively positioned to underlie the target golf ball when the captured tee is driven to the generally horizontal position, wherein the target golf bail striking the flexible material forms a circular imprint of the surface pattern on the flexible material.

20. The golf training device of claim 19 wherein the target golf ball is rotatably attached to the captured tee about the longitudinal axis of the tee and wherein the spin direction recording means further includes:

a pin attached to and extending from the face of the target golf ball at a point on an equator of the target golf ball, whereby the pin of the target golf ball striking the flexible material forms a point imprint of the surface pattern superimposed upon the circular imprint and their relative positions are indicative of the spin direction imparted upon the target golf ball.

21. The golf training device of claim 20 further including an alignment strip applied to the face of the target golf ball and disposed perpendicular to the equator in a line intersecting the pin, whereby the alignment strip facilitates the positioning of the target golf ball so that the pin is pointed in a desired direction before the target golf ball is struck by the golf club.

22. The golf training device of claim 10 further including a direction chart affixed to the frame, the direction chart including a center arrow indicating a desired direction of a golf shot, a plurality of direction arrows spaced at intervals on both sides of the center arrow, and distance indicia corresponding to each of the direction arrows indicating the distance the stroke would drive the ball left or right of the desired direction.

* * * * *